US005617735A

United States Patent [19]

Tomat et al.

[11] Patent Number: 5,617,735

[45] Date of Patent: Apr. 8, 1997

[54] COOLING CHAMBER FOR ROLLED PRODUCTS

[75] Inventors: Ferruccio Tomat; Gino Cattelani, both of Udine; Fausto De Marco, Remanzacco, all of Italy

[73] Assignee: Danieli & C. Officine Meccaniche SpA, Buttrio, Italy

[21] Appl. No.: 628,814

[22] Filed: Apr. 5, 1996

[30] Foreign Application Priority Data

Apr. 12, 1995 [IT] Italy ..... UD95A0065

[51] Int. Cl.[6] ..... F25D 17/02

[52] U.S. Cl. ..... 62/374; 62/63; 62/64

[58] Field of Search ..... 62/63, 64, 373, 62/374

[56] References Cited

U.S. PATENT DOCUMENTS

| | | | |
|---|---|---|---|
| 1,211,277 | 1/1917 | Bloom . | |
| 3,589,429 | 6/1971 | Schoffmann | 164/76 |
| 3,722,077 | 3/1973 | Armstrong | 62/374 X |
| 3,940,294 | 2/1976 | Sergeant | 148/12 |
| 3,983,925 | 10/1976 | Dutzler | 164/283 |
| 4,000,625 | 1/1977 | Beerens et al. | 62/63 |
| 4,040,269 | 8/1977 | Nordblad et al. | 62/374 |
| 4,212,171 | 7/1980 | Soecknick | 62/63 |
| 4,226,092 | 10/1980 | Lüthi | 62/374 |
| 4,654,107 | 3/1987 | Ritter | 156/389 |
| 5,329,779 | 7/1994 | Lozano | 62/374 X |

FOREIGN PATENT DOCUMENTS

| | | |
|---|---|---|
| 141511 | 5/1985 | European Pat. Off. . |
| 312843 | 4/1989 | European Pat. Off. . |
| 1584095 | 12/1969 | France . |
| 7134676 | 9/1973 | Germany . |

*Primary Examiner*—Christopher Kilner
*Attorney, Agent, or Firm*—Antonelli, Terry, Stout & Kraus, LLP

[57] ABSTRACT

Cooling chamber which is of the type installed in a rolling line downstream of the last finishing stand and/or between the finishing stands and comprises a casing (11) containing a cavity (18) for circulation of a cooling fluid cooperating with a lateral opening (17) permitting immission of a cooling fluid and positioned on a plane perpendicular to the longitudinal axis of the casing (11), the casing (11) including a seating (12) for the axial sliding of a slider (14) able to move longitudinally through the fluid circulation cavity (18), the slider (14) containing an axial through bore (15) for the feeding of the rolled product, the fluid circulation cavity (18) being defined by a flange (13) containing an axial through bore (16) which is coaxial with the axial sliding seating (12) and is conformed with a taper cooperating with the slider (14), the flange (13) being complete in itself or extending with a tube (19) to contain the rolled product and cooling fluid, the slider (14) having its downstream portion positioned within the fluid circulation cavity (18), this downstream portion being defined by a first downstream truncated-cone segment (20) having its vertex facing downstream and tapered with a taper "α", a first intermediate cylindrical segment (21) with its axis substantially parallel to the longitudinal axis of the slider (14), a second intermediate tapered segment (22) having a taper "γ" and a second upstream cylindrical segment (23), an outer sidewall (31) defining the axial sliding seating (12) off the slider (14) and extending into the fluid circulation cavity (18) at least to the vicinity of the axis of the lateral opening (17) and being conformed with a taper "α 2" connected (30) to the upstream sidewall of the fluid circulation cavity (18), the bore (16) of the flange (13) including a taper "β" which is a function of the taper "α" of the slider (14).

20 Claims, 3 Drawing Sheets

COOLING CHAMBER FOR ROLLED PRODUCTS

BACKGROUND OF THE INVENTION

This invention concerns a cooling chamber for rolled products.

The cooling chamber according to the invention is installed in rolling lines downstream of the last finishing stand so as to quench the rolled product and/or between the single finishing stands to cool the rolled product passing through and to keep it at the desired temperature.

The cooling chamber according to the invention enables the rolled product passing through to undergo a thermal treatment so as to provide the required physical and mechanical properties.

The cooling chamber according to the invention is employed advantageously, but not only, to cool round reinforcing bars used in reinforced concrete.

The state of the art of rolling lines has included for a long time now the method of cooling rolled products downstream of the last finishing stand and/or between the finishing stands so as to obtain rolled products having the desired physical and mechanical properties.

In that method it is very important that the rolled product should pass through the cooling means without obstructions and should undergo an even and intense cooling action along its whole length.

So as to achieve this result, cooling chambers have been used which contain an axial through bore, within which the rolled product runs axially and cooperates with a cooling fluid under pressure, which is generally water delivered into the cooling chamber.

The cooling fluid in the cooling chambers of the state of the art can run in the same direction as and/or in the opposite direction to the rolled product so as to achieve the most intimate contact with the rolled product in order to cool the latter as quickly and evenly as possible.

Various embodiments have been disclosed for improving the heat exchange between the cooling fluid and the rolled product.

One embodiment arranges to deliver the cooling fluid into the cooling chamber through a plurality of radial holes located at regular intervals in the circumference of the chamber.

In another form of embodiment the cooling chamber includes a casing closed upstream by an axially bored slider and downstream by a flange containing an axial tapered bore coaxial with the slider.

The head of the slider has a truncated-cone conformation which cooperates with the tapered bore of the flange to define an annular hole for the passage of the cooling fluid, which enters the casing through a radial hole in the casing.

The width of the annular hole can be varied by positioning the slider longitudinally.

The results attained by using these embodiments have enabled rolled products to be produced with the desired properties.

The problem entailed by these cooling chambers of the state of the art is linked to the fact that, so as to achieve the required cooling of the rolled product, it is necessary to use a great quantity of cooling fluid, thereby involving high costs for the supply of the cooling fluid and for the conveying and treatment of the fluid before it is discharged.

Another problem of the cooling chambers of the state of the art arises from the corrosion which the threaded coupling portions connecting the slider to the casing undergo owing to the continuous and prolonged contact with water (see for instance EP-A-0141511 and FR-A-1584095).

Another drawback of the cooling chambers of the state of the art arises from the fact that, where a plurality of cooling chambers are arranged in series one next to another, the water leaving the upstream element and heated by contact with the rolled stock to be cooled tends to enter the downstream element, thus impairing the efficiency of the cooling and creating problems which sometimes cannot be overcome at the intake of the rolled stock.

Another drawback of the cooling chambers of the state of the art arises from the geometric shape of the downstream segment of the slider within the cooling chamber, for this shape provides either a segment at an angle to the axis of the chamber (EP-A-0312843, FR-A-1584095—FIG. 3, DE-U-7134676) or a segment parallel to that axis (FR-A-1584095—FIG. 5).

The conformation of this downstream segment of the slider determines the development of the flow within the cooling chamber and thus conditions the efficiency of the cooling action.

These conformations of the state of the art are not the most advisable and suitable for maximising the cooling action performed by the cooling liquid on the rolled stock passing through.

SUMMARY OF THE INVENTION

The present applicants have designed, embodied and tested this invention and have improved the geometric conformation of the components of the cooling chamber so as to overcome the shortcomings of the state of the art and to achieve further advantages such as, above all, a great reduction of the rate of flow of the required cooling fluid.

The cooling chamber according to the invention is shaped structurally to maximise the efficiency of the cooling action on the rolled stock passing through.

In the cooling chamber according to the invention the downstream segment of the slider within the cooling chamber has a first segment inclined in relation to the longitudinal axis of the chamber and followed by a first horizontal segment, which in turn is followed by a second inclined segment and by a second horizontal segment.

This configuration causes a first acceleration of the cooling water in the direction of feed of the rolled stock passing through, and this acceleration is followed by a phase of parallelisation of the fluid streams at the position adjacent to the sidewall of the slider and then by a further acceleration substantially at the outlet of the rolled stock from the slider.

In the cooling chamber according to the invention the upstream segment of the slider has the outer walls of its inlet diverging in the downstream direction; in an analogous manner the outlet of the slider, or of a possible cooling tube associated axially and lengthwise with the slider, has its inner sidewalls flared in the downstream direction.

Where there are a plurality of cooling chambers positioned in series next to each other, this configuration enables the water leaving the upstream cooling chamber to be deviated and to be prevented from entering the downstream cooling chamber.

This situation prevents the rolled stock coming into contact with water already heated by contact with the rolled stock itself.

In the cooling chamber according to the invention the threaded portions coupling the slider to the outer casing are located at a position retracted from the cavity containing the cooling liquid and are protected by packings to prevent the wear and corrosion of those portions due to continuous and prolonged contact with the water.

A further feature of the cooling chamber according to the invention is that the feed of the water into the containing cavity takes place at a tangent to the sidewall of that cavity, thus leading to a circulation of the water which improves the efficiency of the cooling, given an equal rate of flow of water, or else makes possible the use of lower rates of flow of water, given an equal degree of cooling.

The cooling chamber according to the invention has its casing capable of being easily and readily detached from the base, thus assisting the operations of cleaning, maintenance and any replacement of its inner components.

BRIEF DESCRIPTION OF THE DRAWINGS

The cooling chamber according to the invention is shown with some preferred embodiments in the attached tables, which are given as non-restrictive examples as follows.

DETAILED DESCRIPTION OF THE PREFERRED EMBODIMENTS

Figure 1:
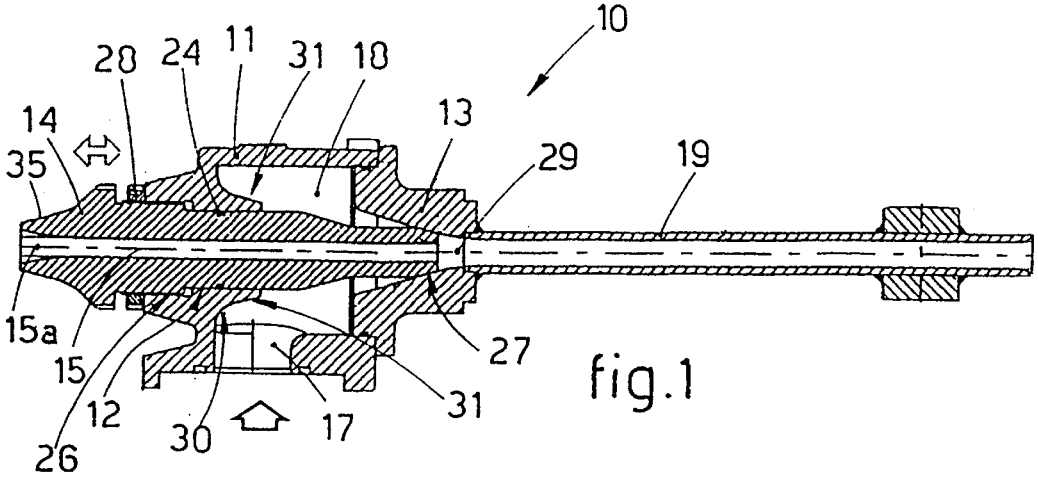
FIG. 1 is a longitudinal section of a first form of embodiment of a cooling chamber according to the invention in association with a tube to contain the rolled product and the cooling fluid.

The purpose of this invention is to provide a cooling chamber 10 for installation upstream and/or downstream of the finishing stands of a rolling line so as to cool quickly to the required temperature the rolled product passing through.

The cooling chamber 10 according to the invention enables the consumption of cooling fluid to be reduced by at least 30% or more as compared to the cooling chambers of the state of the art and at the same time ensures an even and constant cooling of the whole rolled product.

With the cooling chamber 10 according to the invention it is possible to regulate continuously and very accurately the rate of flow of the cooling fluid and thus to control properly the cooling process which the rolled product undergoes when passing through.

The flow of cooling fluid in the cooling chamber 10 according to the invention is in the same direction as that of the feed of the rolled product, thus achieving the twofold effects that the flow of cooling fluid transmits to the rolled product an axial thrust which assists the sliding thereof and that the forward movement of the rolled product draws the cooling fluid and improves its outflow.

The cooling chamber 10 according to the invention has a special geometric configuration, which causes the fluid streams to follow trajectories that improve the heat exchange with the advancing rolled product with a resulting reduction of the overall consumption of cooling fluid.

The cooling chamber 10 according to the invention includes a casing 11 comprising an axial sliding seating 12, in which is positioned a slider 14 able to move longitudinally in a continuous manner and containing a through axial bore 15 through which the rolled product is fed.

The casing 11 is closed at its downstream end by a flange 13, the through bore 16 of which is coaxial with the bore 15 of the slider 14 and is suitably shaped to cooperate with the head of the slider 14; the flange 13 defines together with the casing 11 a cavity 18 for circulation of cooling fluid.

The cavity 18 cooperates with a lateral opening 17 for entry of cooling fluid fed under pressure by a suitable external source.

The lateral opening 17 is positioned on a plane perpendicular to the longitudinal axis of the circulation cavity 18.

Figure 5A:
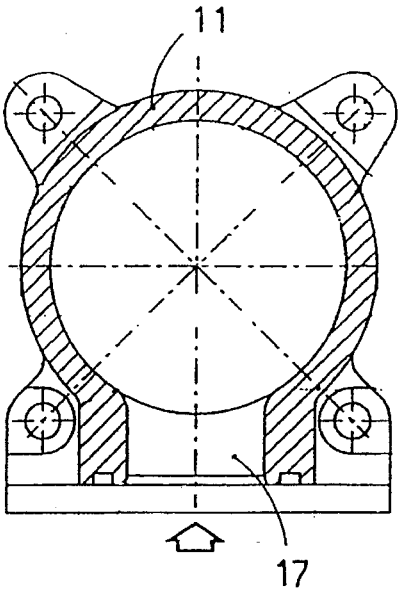
FIG. 5*a* shows a cross-section of the casing of FIG. 4 along the line A—A.

In the form of embodiment shown in FIG. 5*a* the lateral opening 17 is radial to the circulation cavity 18.

Figure 5B:
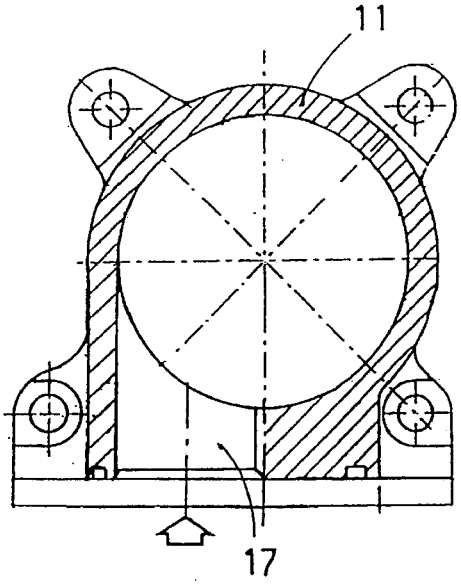
FIG. 5*b* shows a cross-section of a variant of the casing of FIG. 5*a;*

In the form of embodiment of FIG. 5*b* the lateral opening 17 is at a tangent to the inner wall of the circulation cavity 18 of the casing 11, thus inducing a circulation of the cooling water which improves considerably the cooling of the rolled stock, given an equal rate of flow of water, or else makes possible the use of lower rates of flow of water, given an equal degree of cooling.

The cooling chamber 10 according to the invention may include, as shown in FIG. 1, a tube 19 to contain the rolled product and the cooling fluid, this tube 19 being located downstream of and associated with the flange 13 so as to keep the rolled product in contact with the cooling fluid along a segment of a desired length.

Figure 6:
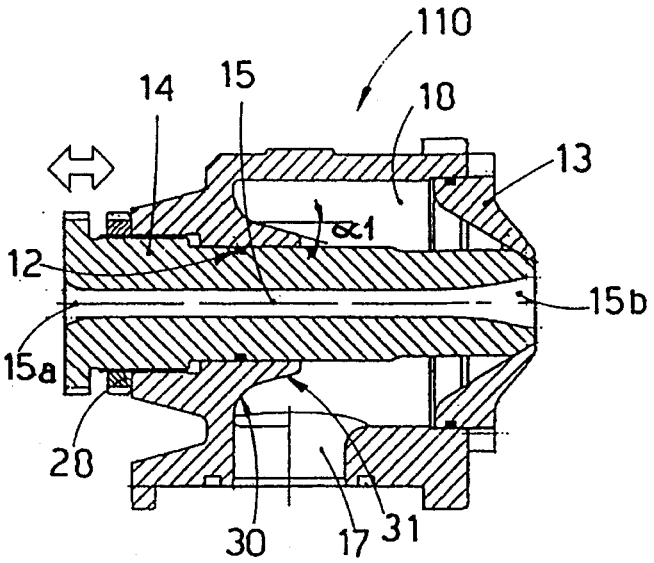
FIG. 6 shows a cooling chamber with the rolled product emerging into the open air.
Figure 8:
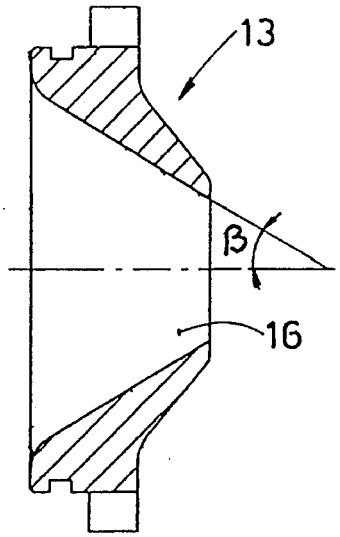
FIG. 8 shows the flange of FIG. 6 in an enlarged scale.
Figure 7:
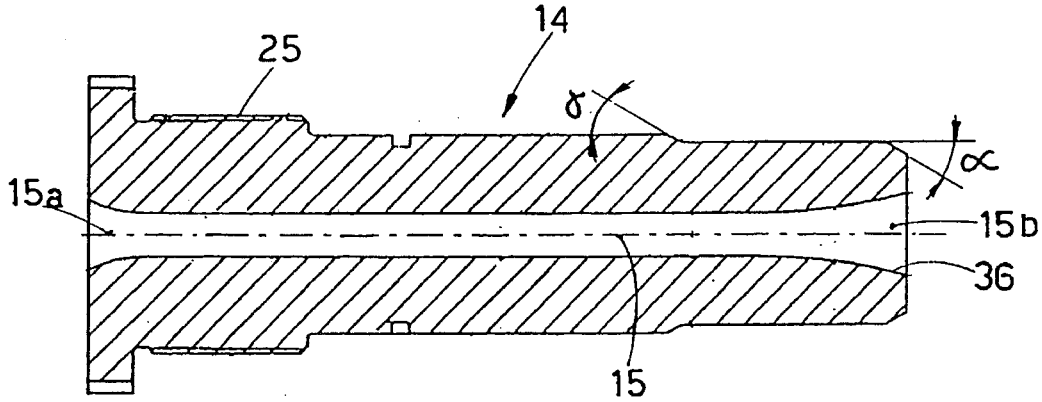
FIG. 7 shows the slider of FIG. 6 in an enlarged scale.
Figure 9:
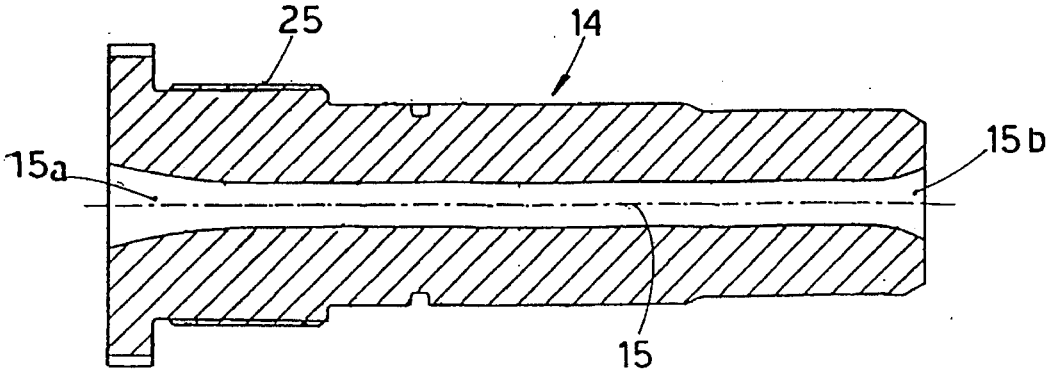
FIG. 9 shows a variant of the slider of FIG. 7.

In the example of FIG. 6 the cooling chamber 110 does not include the downstream tube 19, and the rolled product leaving the cooling chamber 110 is in direct contact with the surrounding air.

In the cooling chamber 10, 110 according to the invention the geometric conformation of the circulation cavity 18, slider 14 and flange 13 is determined in such a way as to ensure intimate contact of the fluid streams with the rolled product so as to improve heat exchange.

In the cooling chamber 10 according to the invention the slider 14 comprises, from its downstream portion in the fluid circulation cavity 18, a first downstream truncated-cone shaped segment 20 with its vertex facing downstream and with a terminal external taper "α", a first intermediate cylindrical segment 21 performing parallelisation of the fluid streams and having an axis substantially parallel to the axis of the chamber 10, a second intermediate tapered segment 22 having a taper "γ" and a second upstream cylindrical segment 23.

The angle "α" and the angle "γ" are normally, though not necessarily, equal to each other.

The tapered segments 20, 22 are suitably connected to the adjacent cylindrical segments 21,23 so as to avoid creating sharp edges which could create elements to disturb the fluid streams.

When installed, the second intermediate tapered segment 22 is embodied in such a way that its downstream end is located downstream of the lateral opening 17 for immission of cooling fluid into the circulation cavity 18 of the casing 11.

When the cooling chamber 10 (FIG. 1) includes the downstream tube 19, the taper "α" is between 14° and 16°, but advantageously 15°, whereas in the cooling chamber 110 (FIG. 6) with the rolled product emerging directly into open air the taper "α" is between 29° and 31°, but advantageously 30°.

The flange 13 has the downstream end of its axial bore 16 narrowed with a taper "β" in the downstream direction; with this end there cooperates the first downstream truncated-cone shaped segment 20 of the slider 14 so as to define an annular passage 27 for the feed of the cooling fluid.

In the cooling chamber 10 according to the invention the taper "β" is equal to the value of the taper "α" plus between 0.3° and 3°, but advantageously 0.5°, so as to ensure a seal engagement when the slider 14 is in its fully forward position in contact with the sidewalls of the bore 16 of the flange 13.

In this case the taper "β" is between 15° and 17°, but advantageously 16°, in the cooling chamber 10 of FIG. 1, and between 30° and 32°, but advantageously 31°, in the cooling chamber 110 of FIG. 6.

Where the cooling chamber 10 is associated with a tube 19 containing the rolled product and the cooling fluid, the length of the bore 16 of the flange 13 is such that it defines at its downstream end an expansion space 29 for the cooling fluid downstream of the slider 14 so as to create a Venturi effect that improves the cooling of the rolled product.

In the cooling chamber 10 according to the invention the cavity 18 of the casing 11 includes an upstream protruding wall 31 defining the axial sliding seating 12 and extending into the circulation cavity 18 at least to the vicinity of the axis of the lateral opening 17. This upstream protruding wall 31 is conformed with a taper "α 1" connected at 30 to the outer wall of the circulation cavity 18.

The taper "α 1" in the cooling chamber 10 according to the invention is between 14° and 16°, but advantageously 15°, so as to create continuity in the fluid streams.

In this way the cooling fluid entering through the lateral opening 17 into the circulation cavity 18 of the casing 11 strikes the rear protruding wall 31 having a taper "α 1" and generates a current with fluid streams suitably directed to improve the heat exchange with the rolled product passing through.

Moreover, the inclination of the fluid streams enables an axial thrust to be imparted to the rolled product passing through.

In the form of embodiment shown in FIG. **5*b* the flow of cooling fluid has a development at a tangent to the circulation cavity 18**, and this development enables the rate of flow of cooling fluid to be further reduced, given an equal degree of required cooling.

With the cooperation of the segments with the tapers "α" and "β" of the slider 14 and of the bore 16 of the flange 13 respectively it is possible, by altering the longitudinal position of the slider 14, to adjust as required the width of the annular passage 27 and therefore the rate of flow of cooling fluid lapping the passing rolled product.

The second upstream cylindrical segment 23 of the slider 14 moves longitudinally in the axial sliding seating 12 of the casing 11 and in this case includes sealing ring means 24 able to ensure a proper seal of the cooling chamber 10.

The slider 14 includes, for adjustment of its longitudinal positioning continuously, a furthermost upstream segment 25 with a male screw thread, which cooperates with a mating female screw thread on the casing 11.

These screw-threaded segments 25, 26 are located at a position retracted from the cavity 18 of circulation of cooling water and the sealing ring means 24 are positioned so as to protect these screw-threaded segments 25, 26 against contact with the water and to preserve them against corrosion.

In this case the slider 14 cooperates with a ring nut 28 for its position to be clamped when the rate of flow has been correctly adjusted.

The axial through bore 15 in the slider 14 for the feeding of the rolled product includes advantageously an initial flared segment **15*a*** to facilitate entry of the rolled product.

Where the cooling chamber 110 terminates with its outlet in the air, the axial through bore 15 of the slider 14 advantageously has its final segment **15*b*** flared in the downstream direction.

The lengths of the respective flared segments **15*a* and 15*b*** can be the same or different.

In the event of two or more cooling chambers 10 positioned in series next to one another, the closeness of the outlet for the rolled stock from the upstream cooling chamber to the inlet for the rolled stock into the downstream cooling chamber causes the entry into the downstream cooling chamber 10 of hot water coming from the upstream cooling chamber 10, thus impairing the complete efficiency of the cooling.

Figure 2:
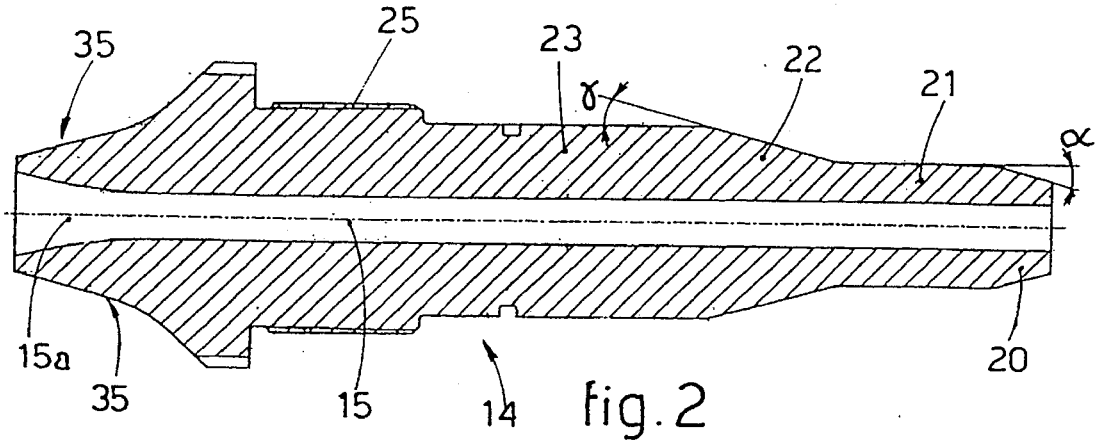
FIG. 2 shows the slider of FIG. 1 in an enlarged scale.
Figure 3:
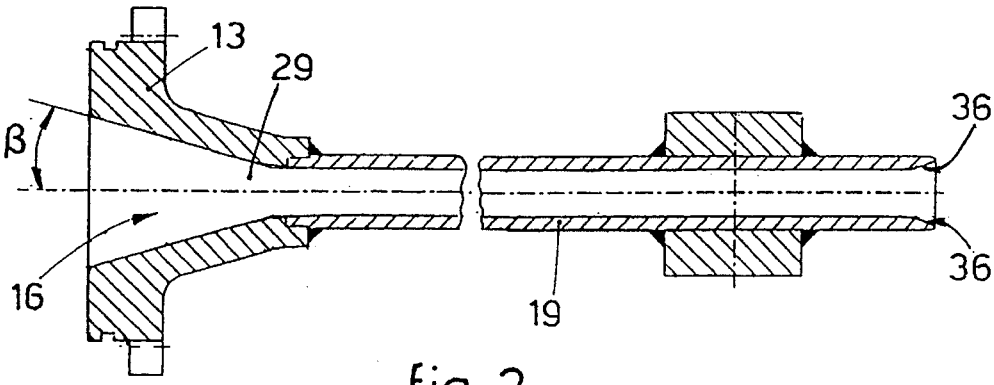
FIG. 3 shows in an enlarged scale the tube containing the rolled product and cooling fluid of FIG. 1.
Figure 4:
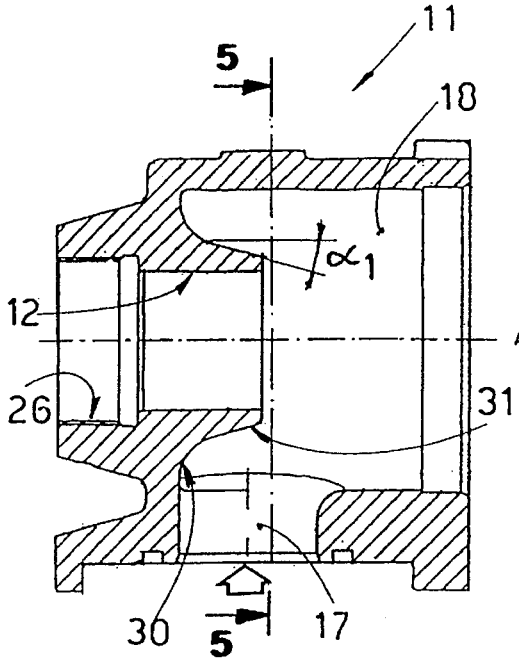
FIG. 4 shows in an enlarged scale the casing of FIG. 1.

According to the invention, so as to restrict this entry of hot water to a minimum, the outer sidewalls 35 defining that inlet have a diverging inclination in the downstream direction such that the water coming from the upstream cooling chamber 10 is deviated outwards (see FIG. 2).

For the same reason, the last downstream segment of the axial bore 15 of the slider 14, or of the axial bore of the tube 19 when included, has its inner sidewalls 36 flared in the downstream direction so as to direct the water outwards and to restrict as much as possible the entry of the water into the slider 14 of the downstream cooling chamber 10.

Figure 10:
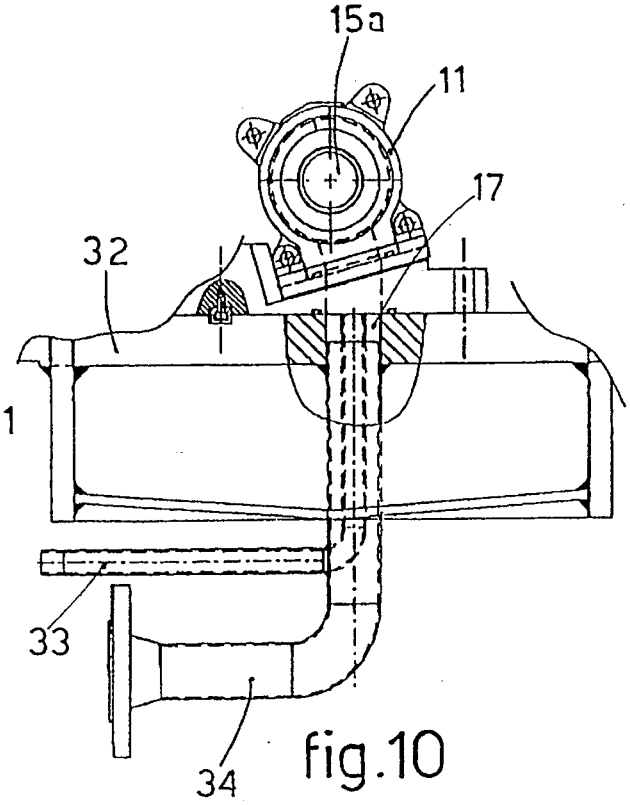
FIG. 10 is a diagram of the system to open the cooling chamber according to the invention for the cleaning thereof.

FIG. 10 shows how the casing 11 can be readily detached on one side or the other from its relative base 32 so as to make possible cleaning and maintenance operations or access to the casing 11 with the use, for instance, of a flow of air fed through a pipe 33 or by using the same pipe 34 as that used to feed the cooling water.

We claim:

1. Cooling chamber to be installed downstream of a finishing stand for cooling a rolled product, comprising:

a casing having a longitudinal axis and containing a fluid circulation cavity for circulation of cooling fluid, a lateral opening permitting introduction of the cooling fluid into the fluid circulation cavity positioned on a plane perpendicular to the longitudinal axis of the casing, an axial sliding seating and a flange at a downstream end of the casing, the flange having an axial bore coaxial with the sliding seating and being narrowed with a taper β in the downstream direction;

a slider able to move longitudinally in the axial sliding seating and having an axial through bore through which the rolled product may be fed, the slider having a first downstream truncated-cone segment having its vertex facing downstream and tapered with a taper α, a first intermediate cylindrical segment with its axis substantially parallel to the longitudinal axis of the slider, a second intermediate tapered segment having a taper γ and a second upstream cylindrical segment;

wherein an outer sidewall defining the axial sliding seating extends into the fluid circulation cavity at least to the vicinity of an axis of the lateral opening and is conformed with a taper α 1 connected to the upstream sidewall of the fluid circulation cavity, and wherein the taper β of the axial bore of the flange is a function of the taper α of the slider.

2. Cooling chamber as in claim 1, further comprising a tube having an axial bore for containing the rolled product and cooling fluid extending from the axial bore in the flange.

3. Cooling chamber as in claim 2 wherein the tapers "α" and "α 1" are between 14° and 16°.

4. Cooling chamber as in claim 2 wherein the tapers "α" and "α 1" are 15°.

5. Cooling chamber as in claim 1 wherein the rolled product emerges from the cooling chamber into open air, the taper "α" is between 29° and 31°, and the taper "α 1" is between 14° and 16°.

6. Cooling chamber as in claim 5, in which the taper "α" is 30°.

7. Cooling chamber as in claim 6, in which the taper "α 1" is 15°.

8. Cooling chamber as in claim 1, wherein the taper "β" is equal to the value of the taper "α" plus a value between 0.3° and 3°.

9. Cooling chamber as in claim 1, wherein the taper "β" is equal to the value of the taper "α" plus a value of 0.5°.

10. Cooling chamber as in claim 1, wherein the lateral opening is radial to the circulation cavity.

11. Cooling chamber as in claim 1, wherein the lateral opening (17) is at a tangent to the inner wall portion of the circulation cavity (18).

12. Cooling chamber as in claim 1 wherein the axial through bore of the slider for the feeding of the rolled product includes an initial flared segment.

13. Cooling chamber as in claim 12, wherein the axial through bore of the slider for the feeding of the rolled product includes a final segment flared in the downstream direction.

14. Cooling chamber as in claim 13, wherein the length of the initial flared segment is at least equal to the length of the final flared segment.

15. Cooling chamber as in claim 13, wherein the initial flared segment is shorter than the final flared segment.

16. Cooling chamber as in claim 2, wherein the length of the axial bore of the flange defines a space for expansion of the cooling fluid downstream of the slider.

17. Cooling chamber as in claim 1 wherein the inlet of the slider has its outer sidewalls diverging in the downstream direction with the purpose of deviating the water.

18. Cooling chamber as in claim 1 wherein the axial through bore of the slider and/or the axial bore of the tube have the last segment of their inner walls flared in the downstream direction.

19. Cooling chamber as in claim 1, further comprising threaded portions providing the coupling of the slider to the casing located at a position retracted from the fluid circulation cavity and protected hydraulically by sealing means.

20. Cooling chamber as in claim 1 wherein the casing (11) can be detached from the relative base (32) for the purposes of cleaning, maintenance and/or access.

* * * * *